US010933458B2

(12) United States Patent
Zhou et al.

(10) Patent No.: US 10,933,458 B2
(45) Date of Patent: Mar. 2, 2021

(54) STRETCH FORMING DIE

(71) Applicants: Dajun Zhou, Troy, MI (US); Changqing Du, Troy, MI (US); Robert D Miller, Lake Orion, MI (US); Richard J Siemen, Shelby Township, MI (US)

(72) Inventors: Dajun Zhou, Troy, MI (US); Changqing Du, Troy, MI (US); Robert D Miller, Lake Orion, MI (US); Richard J Siemen, Shelby Township, MI (US)

(73) Assignee: FCA US LLC, Auburn Hills, MI (US)

( * ) Notice: Subject to any disclaimer, the term of this patent is extended or adjusted under 35 U.S.C. 154(b) by 176 days.

(21) Appl. No.: 16/225,748

(22) Filed: Dec. 19, 2018

(65) Prior Publication Data

US 2020/0197997 A1 Jun. 25, 2020

(51) Int. Cl.

| | |
|---|---|
| ***B21D 24/08*** | (2006.01) |
| ***B21D 25/02*** | (2006.01) |
| ***B21D 22/06*** | (2006.01) |
| ***B21D 22/22*** | (2006.01) |

(52) U.S. Cl.

CPC ..... *B21D 24/08* (2013.01); *B21D 22/06* (2013.01); *B21D 22/22* (2013.01); *B21D 25/02* (2013.01)

(58) Field of Classification Search

CPC ..... B21D 22/22; B21D 24/00; B21D 24/02; B21D 24/04; B21D 24/08; B21D 24/10; B21D 24/14; B21D 25/02

See application file for complete search history.

(56) References Cited

U.S. PATENT DOCUMENTS

| | | | | | |
|---|---|---|---|---|---|
| 1,602,411 | A | * | 10/1926 | Rode | B21D 24/08 72/417 |
| 3,494,169 | A | | 2/1970 | Saunders | |
| 3,575,031 | A | | 4/1971 | Landon | |
| 3,789,649 | A | * | 2/1974 | Clowes | B21D 24/04 72/350 |
| 3,817,076 | A | * | 6/1974 | Wallace | B21D 22/22 72/351 |
| 4,111,030 | A | * | 9/1978 | Shepard | B21D 24/14 267/119 |
| 4,576,030 | A | * | 3/1986 | Roper | B21D 22/02 72/293 |
| 5,979,211 | A | * | 11/1999 | Pahl | B21D 24/08 72/351 |

(Continued)

FOREIGN PATENT DOCUMENTS

| | | |
|---|---|---|
| CN | 107377730 | 11/2017 |

OTHER PUBLICATIONS

Auto/Steel Partnership, "High Strength Steel Stamping Design Manual", www.a-sp.org, p. 1-74 (2000).

(Continued)

*Primary Examiner* — Edward T Tolan

(74) *Attorney, Agent, or Firm* — Ralph E Smith

(57) ABSTRACT

A stamping press binder assembly for forming a finished stamped product from a blank includes an upper die for at least partially forming the finished stamped product, a stationary punch, an inner lower binder, and an outer lower binder. The inner and outer lower binders are both supported by a single cushion.

16 Claims, 3 Drawing Sheets

(56) References Cited

U.S. PATENT DOCUMENTS

| | | | | |
|---|---|---|---|---|
| 6,032,506 | A * | 3/2000 | Kergen | B21D 24/14 72/351 |
| 6,196,043 | B1 * | 3/2001 | Ehardt | B21D 22/22 72/350 |
| 6,276,185 | B1 | 8/2001 | Owens | |
| 8,051,696 | B2 | 11/2011 | Yoshida et al. | |
| 8,850,864 | B2 * | 10/2014 | Kubo | B21D 22/06 72/350 |
| 9,914,164 | B1 | 3/2018 | Siekirk et al. | |
| 2008/0098789 | A1 * | 5/2008 | Hori | B21D 24/04 72/349 |
| 2013/0319068 | A1 | 12/2013 | Zhou et al. | |

OTHER PUBLICATIONS

Ayres, R.A., "SHAPESET: A Process to Reduce Sidewall Curl Springback in High-Strength Steel Rails", vol. 3, No. 2, p. 127-134 (Jan. 1984).

* cited by examiner

STRETCH FORMING DIE

FIELD

The present application relates generally to stamping presses and, more particularly, to a stamping press having a programmable cushion and beadless locking arrangements.

BACKGROUND

Conventional sheet metal forming includes presses with drawing devices having an upper tool or die and a lower tool or punch. The upper tool is typically installed on a lower surface of a vertically movable press ram, and the lower tool typically includes a stationary bottom drawing punch disposed on a press bed. A metal sheet or blank is fed between the upper and lower tools and the upper tool is brought down onto the lower tool to form a stamped metal sheet or panel. However, such stamping techniques to stamp sheet material have led to spring back in the sheet material. Spring back is the geometric change made to the sheet material at the end of the forming process when the sheet material has been released from the machine. Upon completion of the stamping operation, the sheet material springs back thereby affecting the accuracy of the finished sheet material. Modern machines and stamping techniques (e.g., stake beading) use post-stretching methods to reduce spring back at the expense of wasting sheet material, and such methods are additionally limited by the strechability or bendability of the sheet metal. Thus, while many conventional presses work well for their intended purpose, there remains a need for continuous improvement in the relevant art.

SUMMARY

In one example aspect of the invention, a stamping press binder assembly for forming a finished stamped product from a blank is provided. In one example implementation, the press binder assembly includes an upper die for at least partially forming the finished stamped product, a stationary punch, an inner lower binder, and an outer lower binder. The inner and outer lower binders are both supported by a single cushion.

In addition to the foregoing, the described binder assembly may include one or more of the following: wherein the cushion includes a plurality of cushion pins extending between the inner lower binder and at least one high pressure fluid cylinder; wherein the outer lower binder is supported by the inner lower binder; wherein the outer lower binder is supported by a die cylinder having a piston and a second high pressure fluid cylinder; and wherein the second high pressure fluid cylinder is a nitrogen cylinder.

In addition to the foregoing, the described binder assembly may include one or more of the following: wherein the inner lower binder has an upper surface with a plurality of stinger teeth configured to penetrate the blank; wherein the stinger teeth have a pyramidal shape; wherein the plurality of stinger teeth are formed on a stinger insert removably received within a recess formed on the upper surface of the inner lower binder; wherein the stinger insert is removably coupleable to the inner lower binder; wherein the stinger insert includes an outer surface from which the plurality of stinger teeth extend, and an aperture extending therethrough configured to receive a fastener; and wherein the aperture is a threaded aperture.

In addition to the foregoing, the described binder assembly may include one or more of the following: wherein the cushion is programmable and includes a plurality of cushion pins extending between the inner lower binder and at least one first high pressure fluid cylinder, and wherein the outer lower binder is supported by a die cylinder having a piston and a second high pressure fluid cylinder, wherein the binder assembly further comprises a controller programmed to set the programmable cushion with a first predetermined cushion force and move the upper die downward a first predetermined distance, set the programmable cushion with a second predetermined cushion force and move the upper die further downward a second predetermined distance such that the die cylinder is at least partially compressed, and set the programmable cushion with a third predetermined cushion force and move the upper die further downward a third predetermined distance such that a plurality of stinger teeth on an upper surface of the inner lower binder penetrate the blank to facilitate substantially locking sheet draw-in.

In addition to the foregoing, the described binder assembly may include one or more of the following: wherein the second predetermined force is greater than the first predetermined force; wherein the third predetermined force is greater than the second predetermined force; and wherein the first predetermined force is 20 tons, the second predetermined force is 40 tons, and the third predetermined force is 100 tons.

In accordance with another example aspect of the invention, a method of forming a finished stamped product from a blank in a stamping press binder assembly having an upper die, a stationary punch, an inner lower binder, an outer lower binder, and a die cylinder disposed on the inner lower binder and supporting the outer lower binder, wherein the inner and outer lower binders are both supported by a single cushion is provided. In one example implementation, the method includes positioning the blank on the outer lower binder and the stationary punch, setting the cushion with a first predetermined cushion force and moving the upper die downward a first predetermined distance, setting the cushion with a second predetermined cushion force and moving the upper die further downward a second predetermined distance such that the die cylinder is at least partially compressed, and setting the cushion with a third predetermined cushion force and moving the upper die further downward a third predetermined distance such that a plurality of stinger teeth on an upper surface of the inner lower binder penetrate the blank to facilitate substantially locking sheet draw-in to reduce springback.

In addition to the foregoing, the described method may include one or more of the following: removably coupling a stinger insert to the inner lower binder, the stinger insert having an outer surface with the plurality of stinger teeth extending therefrom configured to penetrate the blank; wherein the stinger insert is removably coupled within a recess formed in an upper surface of the inner lower binder; and forming the stinger teeth with a pyramidal shape.

Further areas of applicability of the teachings of the present application will become apparent from the detailed description, claims and the drawings. It should be understood that the detailed description, including disclosed embodiments and drawings referenced therein, are merely exemplary in nature intended for purposes of illustration only and are not intended to limit the scope of the present application, its application or uses. Thus, variations that do not depart from the gist of the present application are intended to be within the scope of the present application.

DESCRIPTION

The present application is generally directed to systems and methods for controlling draw-in of a sheet metal blank during a stamping process. In one example, a stamping press includes a dual binder on a single cushion configured to hold the blank between teeth on one of the binders to reduce draw-in or even lock the sheet's movement for springback reduction. In another example, the stamping press includes a single lower binder with stinger teeth, as opposed to stinger beads, to reduce draw-in or even lock the sheet's movement for springback reduction. In some examples, the teeth are formed on replaceable inserts removably coupled to the lower binder.

Figure 2:
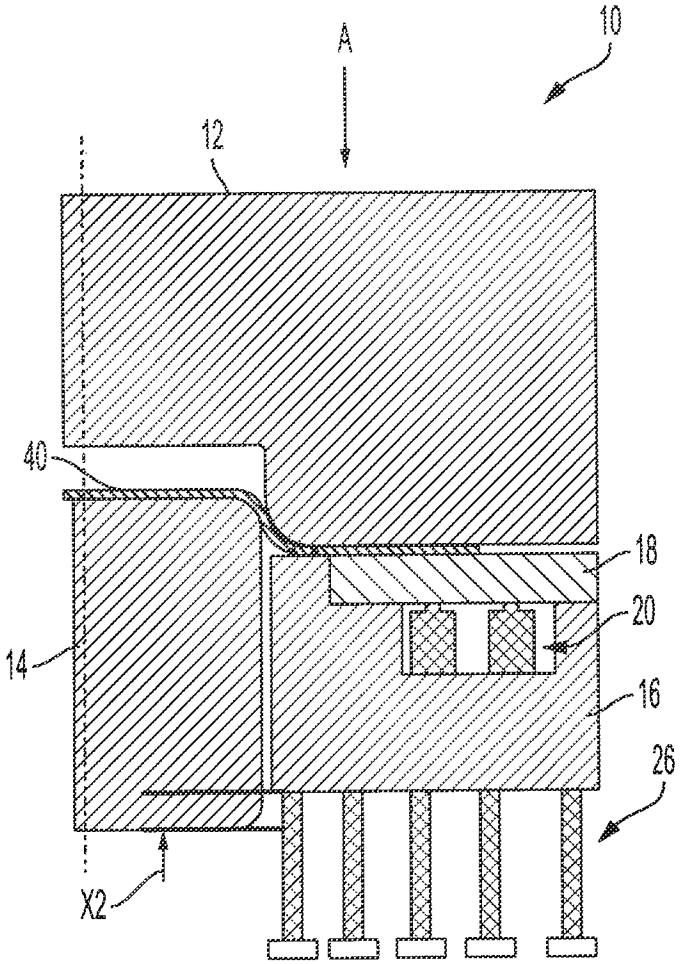
FIG. 2 is a schematic cross-sectional view of the binder assembly of FIG. 1 in a second position, according to the principles of the present disclosure.
Figure 1:
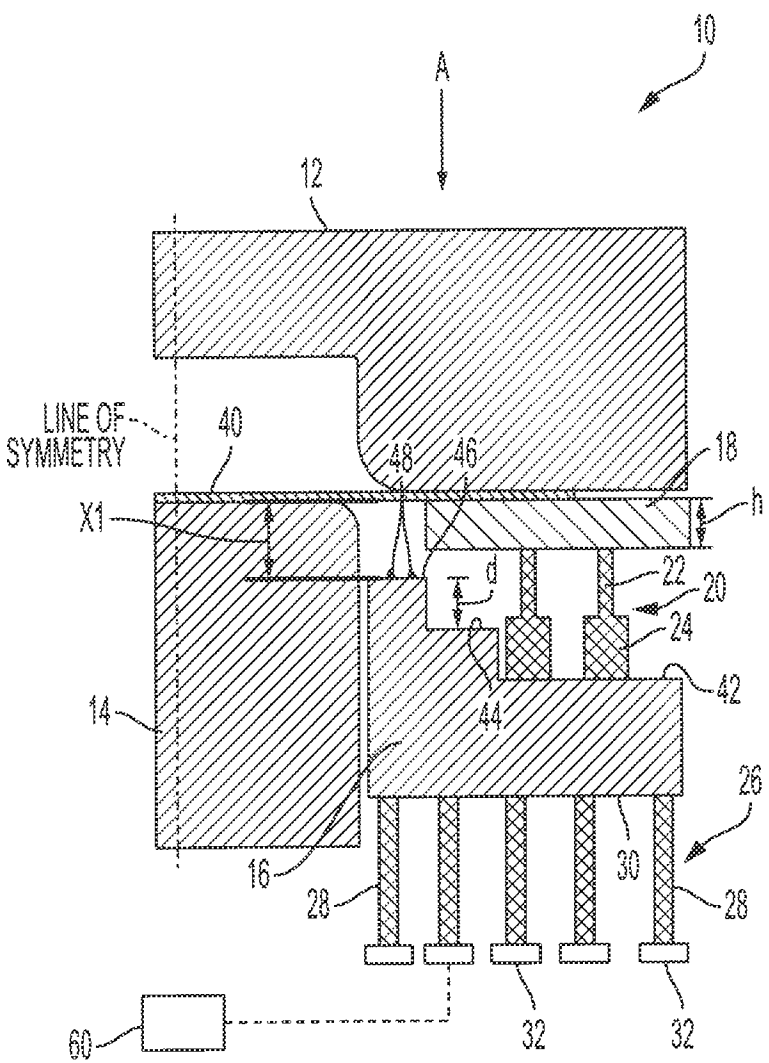
FIG. 1 is a schematic cross-sectional view of an example stamping press binder assembly in a first position, according to the principles of the present disclosure.
Figure 3:
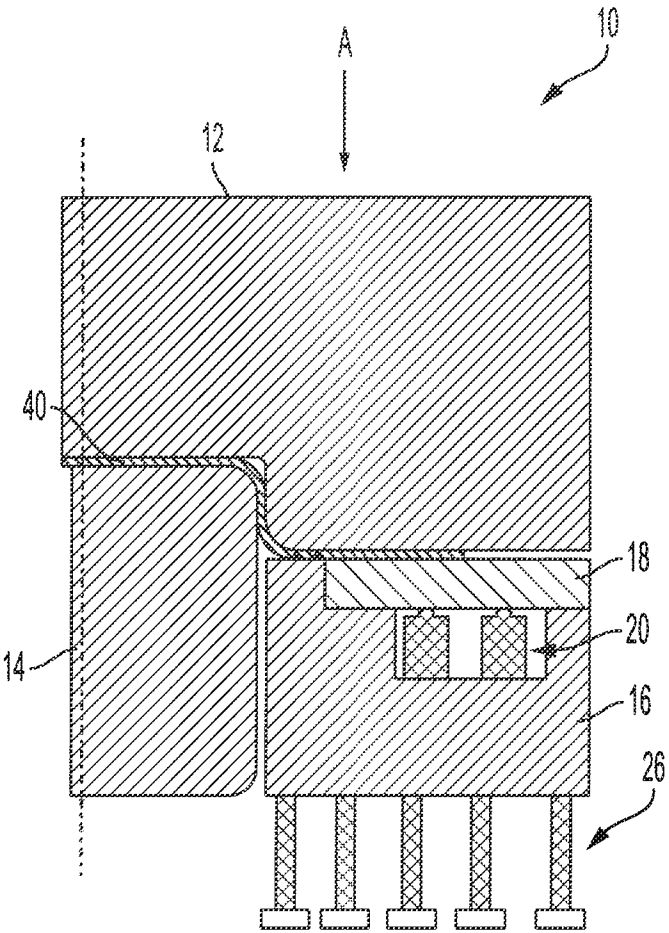
FIG. 3 is a schematic cross-sectional view of the binder assembly of FIG. 1 in a third position, according to the principles of the present disclosure.

Referring to FIGS. 1-3, an example stamping press binder assembly is generally shown and indicated at reference numeral 10. In the example embodiment, binder assembly 10 generally includes an upper die 12, a punch 14, an inner lower binder 16, and an outer lower binder 18. The inner and outer lower binders 16, 18 extend around the punch 14 and are movable relative thereto. The outer lower binder 18 is supported by one or more die cylinders 20 (e.g., a die spring) having a piston 22 slidably received within a cylinder 24 connected to a source of high pressure fluid (e.g., nitrogen). As illustrated, the cylinder 24 is disposed on and supported by the inner lower binder 16. The pressure of the fluid is adjustable and configured to bias the piston 22 upward (as shown in FIG. 1), thereby biasing the outer lower binder 18 upward with a predetermined adjustable force.

In the example embodiment, the inner and outer lower binders 16, 18 are both supported by a single, programmable cushion 26, which includes a plurality of pistons or press cushion pins 28 attached to a bottom surface 30 of the inner lower binder 16. The press cushion pins 28 are received within one or more cylinders 32 connected to a pressure variable source of high pressure fluid (not shown) to thereby provide a variable cushion force to the inner and outer lower binders 16, 18. The cylinders 32 (e.g., nitrogen cylinders) are configured provide a force to the inner lower binder 16 via press cushion pins 28 to maintain the inner and outer lower binders 16, 18 in a rest position until the inner lower binder 16 is forced downward by the upper die 12 as the upper die 12 moves toward the lower binders 16, 18.

As shown in FIG. 1, a workpiece or blank 40 (e.g., sheet metal) is initially positioned on the punch 14 and the outer lower binder 18 such that the blank 40 extends laterally between the upper die 12 and the punch 14 and outer lower binder 18. The upper die 12 is driven downwardly an initial distance 'X1' in a direction 'A' toward the punch 14. In the illustrated example, the inner lower binder 16 includes a first upper surface 42, a relatively higher second upper surface 44, and relatively higher third upper surface 46. The first upper surface 42 is configured to receive cylinders 24, and third upper surface 46 includes a plurality of stinger teeth 48.

As shown in FIG. 2, downward movement of upper die 12 over distance 'X1' causes downward movement of the outer lower binder 18 until an outer lower binder upper surface 50 is parallel with or substantially parallel with the third upper surface 46. As such, in one example, a height 'h' of the outer lower binder 18 is equal to or substantially equal to a distance 'd' between the second and third upper surfaces 44, 46. At a point before the blank 40 contacts the stinger teeth 48, the high pressure fluid source is controlled to initially set cushion 26 at a relatively lower first cushion force (e.g., 40 tons). This enables the stinger teeth 48 to bite into the lower surface of blank 40 while performing an initial shaping of the blank 40 over the punch 14, without sheet-draw in that causes material waste.

In the position shown in FIG. 2, the blank 40 is thus clamped between the upper die 12 and both inner and outer lower binders 16, 18. The stinger teeth 48 bite into the lower surface of blank 40 to lock or substantially lock the sheet draw-in. The high pressure fluid source is controlled to subsequently set cushion 26 at a relatively higher second cushion force (e.g., 100 tons), and the upper die 12 is further moved in direction 'A' a second distance 'X2' (FIG. 2) to finally form the blank 40 around the stationary punch 14 in a full strike or press (FIG. 3).

Figure 4:
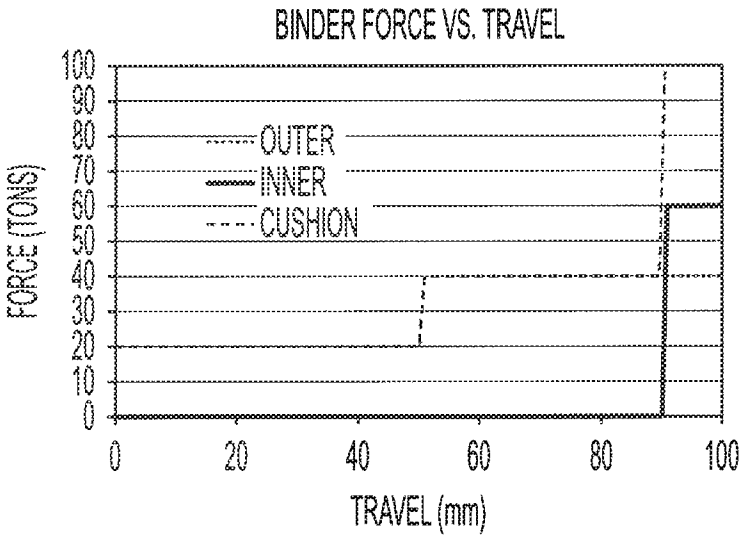
FIG. 4 is a graphical illustration of an example cushion force of the binder assembly shown in FIG. 1, according to the principles of the present disclosure.

With additional reference to FIG. 4, one example operation of binder assembly 10 is described in more detail. In the example embodiment, die cylinder 20 is a nitrogen cylinder set with a first predetermined cushion force (e.g., 40 tons or approximately 40 tons). In a first step, cushion 26 is set with a second predetermined cushion force (e.g., 20 tons or approximately 20 tons) as the upper die 12 travels a first predetermined distance (e.g., from zero mm or approximately zero mm to 50 mm or approximately 50 mm). During this first predetermined travel distance, the nitrogen cylinder 20 is not compressed, and both the inner and outer lower binders 16, 18 are forced downward together by the downward movement of upper die 12.

In a second step, the programmable cushion 26 is set with a third predetermined cushion force (e.g., 40 tons or approximately 40 tons) as the upper die 12 subsequently travels a second predetermined distance (e.g., from 50 mm or approximately 50 mm to 90 mm or approximately 90 mm. During this travel, the nitrogen cylinder 20 is compressed, and the outer lower binder 18 moves downward while the lower inner binder 16 remains stationary or substantially stationary.

In a third step, the programmable cushion 26 is set with a fourth predetermined cushion force (e.g., 100 tons or approximately 100 tons) as the upper die 12 subsequently travels a third predetermined distance (e.g., from 90 mm or approximately 90 mm to 100 mm or approximately 100 mm) to a home position (FIG. 3). During this travel, the nitrogen cylinder 20 is fully compressed and the stinger teeth 48 bite into blank 40, and both the inner and outer lower binders 16, 18 move downward together to the home position to form the blank 40 into a finally formed workpiece.

Figure 5:
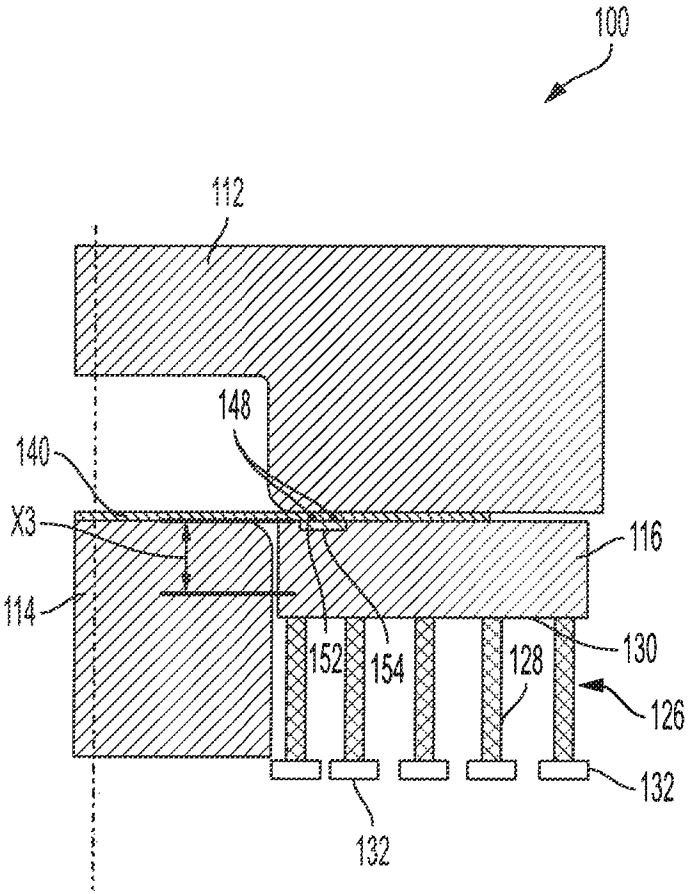
FIG. 5 is a schematic cross-sectional view of another example servo stamping press binder assembly in a first position, according to the principles of the present disclosure.

Referring to FIG. 5, another example stamping press binder assembly is generally shown and indicated at reference numeral 100. In the example embodiment, binder assembly 100 generally includes an upper die 112, a punch 114, and a lower binder 116. The lower binder 116 extends around the punch 114 and is movable relative thereto.

In the example embodiment, the lower binder 116 is supported by a cushion 126, which includes a plurality of pistons or press cushion pins 128 attached to a bottom surface 130 of the lower binder 116. The press cushion pins 128 are received within one or more cylinders 132 connected to a pressure variable source of high pressure fluid (not shown) to thereby provide a variable cushion force to the lower binder 116.

As shown in FIG. 5, the lower binder 116 is disposed at the same height or substantially the same height as the punch 114 and a workpiece or blank 140 (e.g., sheet metal) is initially positioned on the punch 114 and the lower binder 116. As such, the blank 140 extends laterally between the upper die 112 and the punch 114 and lower binder 116.

Figure 6:
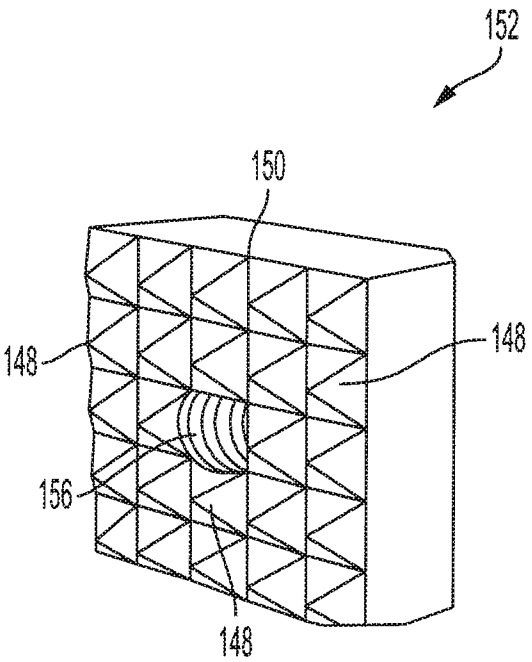
FIG. 6 is a perspective view of an example stinger insert that may be used in the binder assemblies shown in FIGS. 1 and 5, according to the principles of the present disclosure.

In the illustrated example, the lower binder 116 includes an upper surface 142 having a plurality of stinger teeth 148. In the example embodiment, and with further reference to FIG. 6, stinger teeth 148 are formed in an outer surface 150 of a stinger insert 152. However, it will be appreciated that stinger teeth 148 may be integrally formed in the lower binder upper surface 142.

In the example embodiment, stinger teeth 148 are formed in outer surface 150 for example, by laser or machining. The stinger teeth 148 may be formed in various shapes, patterns, textures, etc. as long as the teeth 148 (i.e., sharp features) can penetrate or bite into the surface of blank 140 and facilitate preventing sheet-tool sliding. For example, teeth 148 may be pyramidal. As such, the stinger teeth 148 are different from draw beads or stinger beads which use lock beads or high force beads to stop sheet metal draw-in movement. Many of such beads prevent the draw-in and thus springback conditions at the expense of wasting sheet material (extra sheet material is wrapped around the bead outer surface). Accordingly, binder assembly 100 advantageously reduces or eliminates sheet material waste by preventing or reducing sheet draw-in movement without beads.

In the example embodiment, the stinger insert 152 is configured to be received within a cavity or recess 154 formed in the lower binder upper surface 142. The recess 154 is sized such that when the stinger insert 152 is received therein, only a small portion (e.g., teeth 148) extend beyond the plane defined by lower binder upper surface 142. The stinger insert 152 is configured to be removably coupled to the lower binder 116 by any suitable means such as, for example, via a fastener, clip, etc. In the example embodiment, stinger insert 152 includes at least one threaded aperture 156 configured to threadably receive a fastener (not shown), which extends through stinger insert 152 and engages the lower binder 116 to secure the stinger insert 152 thereto. As such, a stinger insert 152 can be quickly and easily replaced on lower binder 116, for example, when stinger teeth 148 break or become worn, thereby reducing cost and press down-time during maintenance. It will be appreciated that stinger insert 152 is not limited to use with binder assembly 100 and may be utilized with other presses such as, for example the binder assembly 10.

In operation, the upper die 112 is driven downwardly an initial distance 'X3' in a direction 'A' toward the punch 114. Upon initial movement, the blank 140 is clamped between the upper die 112 and the lower binder 116. The upper die 112 forces the stinger teeth 148 to bite into the lower surface of blank 140 to thereby lock or substantially lock the sheet draw-in. The upper die 112 is subsequently moved downward the full distance 'X3' to the home position to form the blank 140 around the stationary punch 114 into a finally formed workpiece.

In the example embodiments, binder assemblies 10, 100 are digitally programmable and include a programmable controller 60 for controlling movements and components of the binder assemblies 10, 100. As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality.

Described herein are systems and methods for controlling draw-in of a sheet metal blank during a stamping process. One example system includes a dual lower binder supported by a single, programmable cushion to reduce draw-in or even lock the sheet's movement for springback reduction. Another example system includes a beadless lower binder with stinger teeth for locking sheet draw-in for springback reduction. In another example, the stinger teeth are formed on a stinger insert that is removably coupled to the lower binder for quick and easy replacement of stinger teeth.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. A stamping press binder assembly for forming a finished stamped product from a blank, the press binder assembly comprising:

an upper die for at least partially forming the finished stamped product;

a stationary punch positioned below the upper die;

an inner lower binder;

an outer lower binder moveably positioned on the inner lower binder; and a single cushion;

wherein the inner and outer lower binders are both supported by the single cushion, and wherein the cushion is programmable and includes a plurality of cushion pins extending between the inner lower binder and at least one first high pressure fluid cylinder, and wherein the outer lower binder is supported by a die cylinder having a piston and a second high pressure fluid cylinder, wherein the binder assembly further comprises a controller configured to:

set the programmable cushion with a first predetermined cushion force and move the upper die downward a first predetermined distance;

set the programmable cushion with a second predetermined cushion force and move the upper die further downward a second predetermined distance such that the die cylinder is at least partially compressed; and set the programmable cushion with a third predetermined cushion force and move the upper die further downward a third predetermined distance such that a plurality of stinger teeth on an upper surface of the inner lower binder penetrate the blank to facilitate substantially locking sheet draw-in.

2. The binder assembly of claim 1, wherein the outer lower binder is supported by the inner lower binder and configured to nest within a recessed area of the inner lower binder.

3. The binder assembly of claim 1, wherein the second high pressure fluid cylinder is a nitrogen cylinder.

4. The binder assembly of claim 1, wherein the inner lower binder has an upper surface with a plurality of stinger teeth configured to penetrate the blank.

5. The binder assembly of claim 4, wherein the stinger teeth have a pyramidal shape.

6. The binder assembly of claim 5, wherein the plurality of stinger teeth are formed on a stinger insert removably received within a recess formed on the upper surface of the inner lower binder.

7. The binder assembly of claim 6, wherein the stinger insert is removably coupleable to the inner lower binder.

8. The binder assembly of claim 7, wherein the stinger insert includes an outer surface from which the plurality of stinger teeth extend, and an aperture extending therethrough configured to receive a fastener.

9. The binder assembly of claim 8, wherein the aperture is a threaded aperture.

10. The binder assembly of claim 1, wherein the second predetermined force is greater than the first predetermined force.

11. The binder assembly of claim 10, wherein the third predetermined force is greater than the second predetermined force.

12. The binder assembly of claim 11, wherein the first predetermined force is 20 tons, the second predetermined force is 40 tons, and the third predetermined force is 100 tons.

13. A method of forming a finished stamped product from a blank in a stamping press binder assembly having an upper die, a stationary punch, an inner lower binder, an outer lower binder, and a die cylinder disposed on the inner lower binder and supporting the outer lower binder, wherein the inner and outer lower binders are both supported by a single cushion, the method comprising:

positioning the blank on the outer lower binder and the stationary punch;

setting the cushion with a first predetermined cushion force and moving the upper die downward a first predetermined distance;

setting the cushion with a second predetermined cushion force and moving the upper die further downward a second predetermined distance such that the die cylinder is at least partially compressed; and setting the cushion with a third predetermined cushion force and moving the upper die further downward a third predetermined distance such that a plurality of stinger teeth on an upper surface of the inner lower binder penetrate the blank to facilitate substantially locking sheet draw-in to reduce springback.

14. The method of claim 13, further comprising removably coupling a stinger insert to the inner lower binder, the stinger insert having an outer surface with the plurality of stinger teeth extending therefrom configured to penetrate the blank.

15. The method of claim 14, wherein the stinger insert is removably coupled within a recess formed in an upper surface of the inner lower binder.

16. The method of claim 15, further comprising forming the stinger teeth with a pyramidal shape.

* * * * *